US005364076A

United States Patent [19]

Nicholls

[11] Patent Number: 5,364,076

[45] Date of Patent: Nov. 15, 1994

[54] BARRIER STRUCTURE

[76] Inventor: Oswald C. J. Nicholls, 21 Ingleside Crescent, Glen Waverley, Victoria, 3150, Australia

[21] Appl. No.: 859,383

[22] PCT Filed: Sep. 24, 1990

[86] PCT No.: PCT/AU90/00448

§ 371 Date: Jul. 10, 1992

§ 102(e) Date: Jul. 10, 1992

[87] PCT Pub. No.: WO91/04383

PCT Pub. Date: Apr. 4, 1991

[30] Foreign Application Priority Data

Sep. 22, 1989 [AU] Australia ..... PJ6516/89

[51] Int. Cl.[5] ..... E04H 17/00

[52] U.S. Cl. ..... 256/22; 256/24; 256/26; 256/65

[58] Field of Search ..... 256/24, 26, 22, 47, 256/65, 73, DIG. 2, DIG. 5

[56] References Cited

U.S. PATENT DOCUMENTS

| | | | |
|---|---|---|---|
| 1,765,488 | 6/1930 | Hunter | 256/24 |
| 3,304,683 | 2/1967 | Ferreira | 256/65 |
| 4,083,535 | 4/1978 | Britt | 256/DIG. 2 |
| 4,124,198 | 11/1978 | Wong | 256/24 |
| 4,148,277 | 4/1979 | Engle | 256/24 |
| 4,465,262 | 8/1984 | Itri | 256/24 |
| 5,100,108 | 3/1992 | Schultz | 256/73 |

FOREIGN PATENT DOCUMENTS

| | | | |
|---|---|---|---|
| 4276/51 | 1/1952 | Australia . | |
| 403595 | 5/1967 | Australia . | |
| 67695/81 | 9/1981 | Australia . | |
| 45551/89 | 5/1990 | Australia . | |
| 8000064 | 1/1980 | Netherlands . | |
| 138325 | 5/1920 | United Kingdom . | |
| 536646 | 5/1941 | United Kingdom | 256/65 |
| 1258468 | 12/1971 | United Kingdom . | |
| 1356059 | 6/1974 | United Kingdom . | |
| 2214551 | 6/1989 | United Kingdom . | |

*Primary Examiner*—Randolph A. Reese
*Assistant Examiner*—Anthony Knight
*Attorney, Agent, or Firm*—Ladas & Parry

[57] ABSTRACT

A barrier structure includes a barrier and elongate support members. The barrier includes upper and lower engaging parts that engage the engaging portions of the elongate members adapted to receive the engaging parts. Securing elements fit on the supporting members to secure the upper engaging parts to their respective engaging portions. A method of erecting a barrier structure is also provided. First, the lower parts of the barrier are received into their respective engaging portions of the elongate support members. Then the upper engaging parts are received by their respective engaging portions and the securing elements fitted onto the support members.

12 Claims, 7 Drawing Sheets

BARRIER STRUCTURE

The present invention relates to a barrier structure.

In accordance with the present invention there is provided a barrier structure comprising:

barrier means including upper and lower engaging parts;

elongate support members having engaging portions adapted to receive said engaging parts, respectively; and securing means adapted to fit on said support members so as to secure said upper engaging parts to their respective engaging portions.

Preferably said support members are inserted into a base so as to secure said lower engaging pans to their respective engaging portions.

Preferably said engaging portions comprise slots.

Preferably said slots include upper slots adjacent a first end of said members to receive said upper engaging parts, and lower slots adjacent a second end of said members to receive said lower engaging parts.

Preferably said engaging pans are protrusions disposed on the sides of said barrier means.

Alternatively the engaging pans may comprise slots and the engaging portions may comprise protrusions.

The present invention also provides a method of erecting said structure, comprising:

causing said lower parts to be received by their respective engaging portions;

causing said upper parts to be received by their respective engaging portions; and fitting said cap means on said support members.

Preferably said upper parts are caused to engage their respective engaging portions by pivoting said barrier means after the lower parts have been caused to engage their respective engaging portions.

Preferably said method further comprises causing said support members to be received in said base before said barrier means is pivoted.

Preferred embodiments of the present invention will now be described, by way of example only, with reference to the accompanying drawings wherein.

Figure 1:
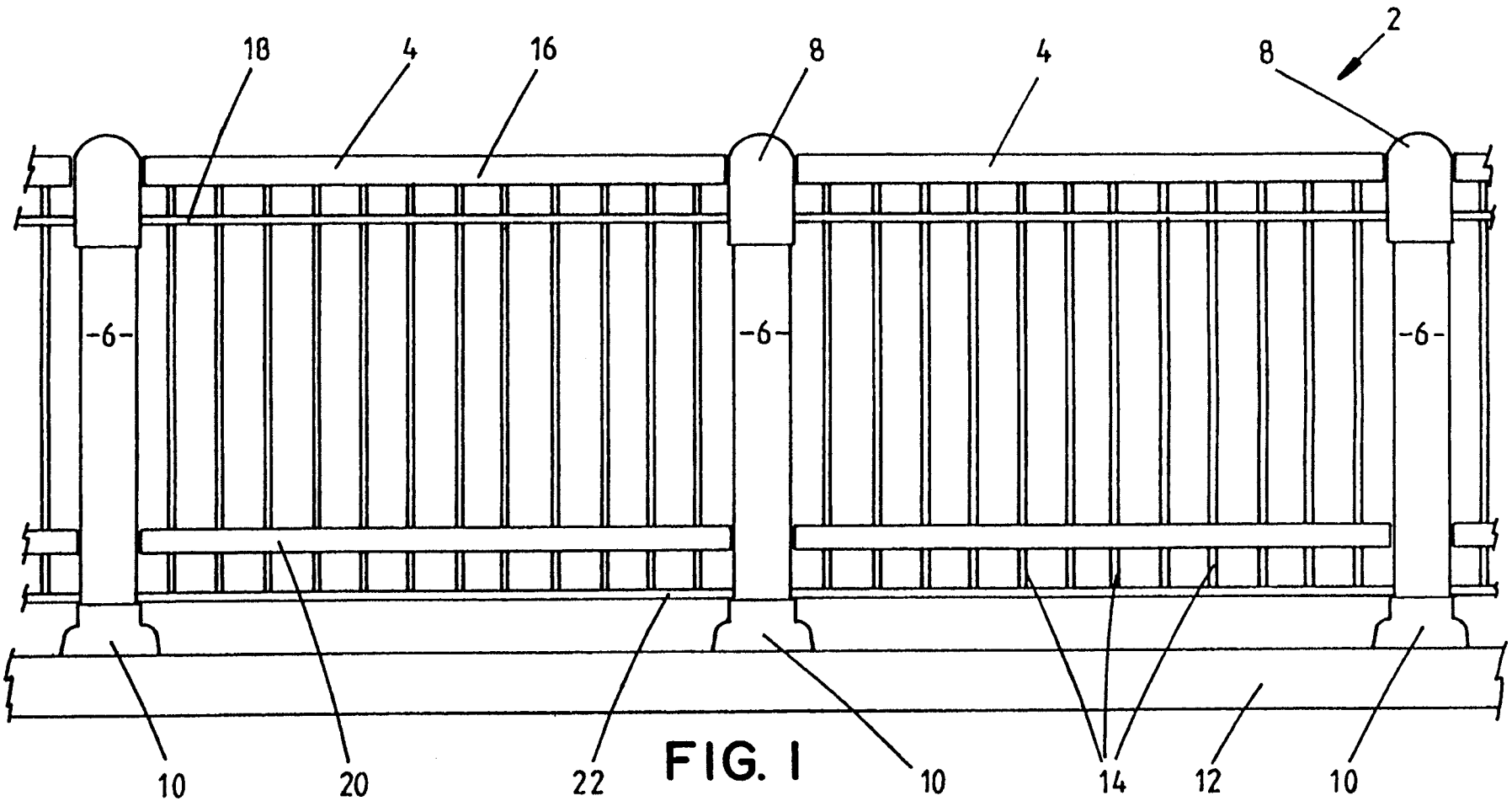
FIG. 1 is a front view of a first preferred embodiment of a barrier structure.

A barrier structure 2, as shown in FIG. 1, includes a number of rails 4 which are supported by a series of posts 6. The posts have caps 8 fitted over the top ends thereof and stand in respective bases 10. The bases 10 sit on a floor structure 12, which may comprise a verandah, balcony or merely the ground. The rails 4 include a plurality of vertical bars 14 and two upper horizontal bars 16 and 18 and two lower horizontal bars 20 and 22.

Figure 2:
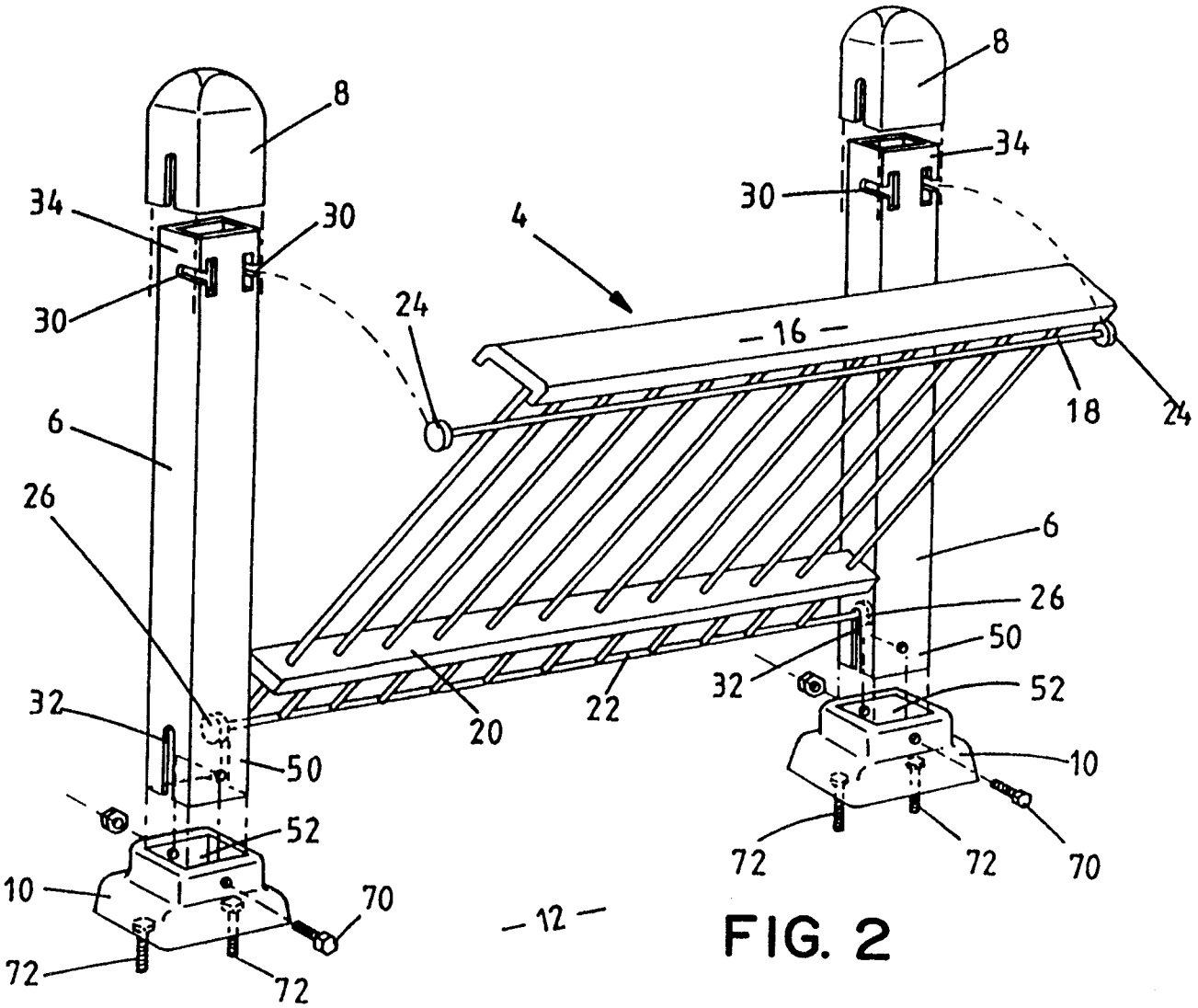
FIG. 2 is a perspective view of the barrier structure illustrating how it is erected.

The second upper and lower bars 18 and 22 are slightly longer and protrude past the ends of the first upper and lower bars 16 and 20, as shown in FIG. 2, and include disc-shaped knobs, 24 and 26 respectively disposed on the ends thereof. The knobs 24 and 26 are adapted to be received by respective slots 30 and 32 disposed in the sides of the posts 6 at each end thereof.

Figure 7:
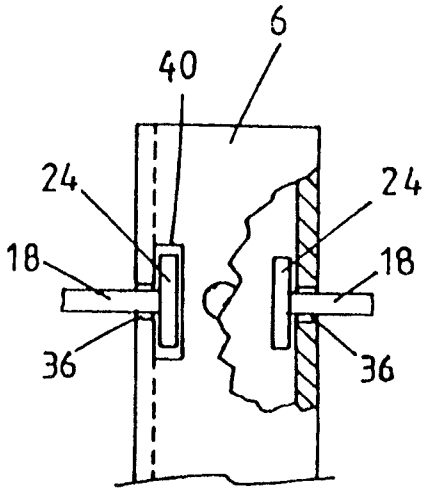
FIG. 7 is a front partial cross-sectional view of the top end of a post.
Figure 5:
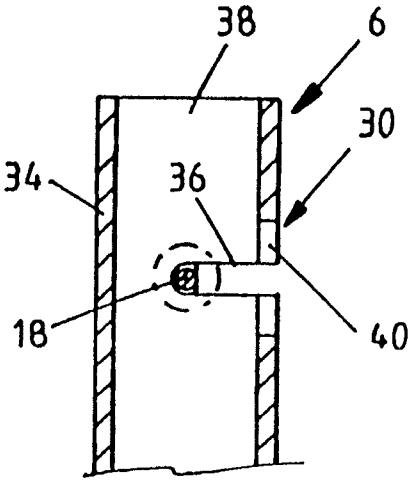
FIG. 5 is a side cross-sectional view of the top end of a post.

The posts 6 are elongate hollow tubes having a rectangular cross-section. The slots 30 disposed at the upper end 34 of the posts 6, as best illustrated in FIGS. 2, 5 and 7, include a horizontal slot portion 36 which is provided in the respective side 38 of the post 6 and a vertical slot portion 40 which is provided in the front of the post 6. The vertical slot portion 40 is configured to enable a knob 24 of the upper bar 18 to be passed therethrough so that the knob 24 is then disposed in the post 6 and part of the upper bar 18 rests in the vertical slot portion 36 at the end thereof, as shown in FIG. 5. The knobs 24 prevent the upper bars 18 from being removed longitudinally from the post 6 in the direction of the axes of the bars 18.

Figure 6:
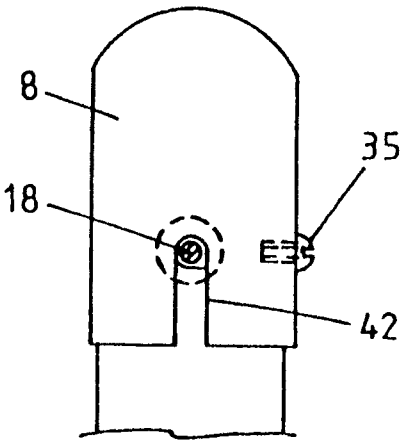
FIG. 6 is a side view of the top end of the post with a cap fitted thereto.

To secure the ends of the bars 18 fully and prevent them being removed via the vertical slot portion 40 a cap 8, as shown in FIGS. 2 and 6, is inserted over the upper end 34 of the post 6 so as to cover the vertical slot portion 40. The cap 8 includes vertical slots 42 disposed in the sides thereof which extend to the lower ends of the caps 8. The slots 42 are adapted to receive the upper bars 18 and act to inhibit lateral movement of the bars 18 along the horizontal slot portion 36 and ensure the bars 18 remain at the end of the slot portion 36, as shown in FIG. 6. The cap 8 may be further secured to the top end 34 of the post 6 by a bolt, or screw, 35.

The slots 32 disposed at the lower ends 50 of the posts 6 are vertical slots which extend to the bottom of the posts 6 and are disposed on each side of a post 6. The slots 32 are configured to receive the ends of the lower bars 22 so that the knobs 26 are disposed in the posts 6 and thereby prevent the bars 22 being laterally and longitudinally removed from the posts 6 relative to the direction of the axes of the bars 22.

Figure 3:
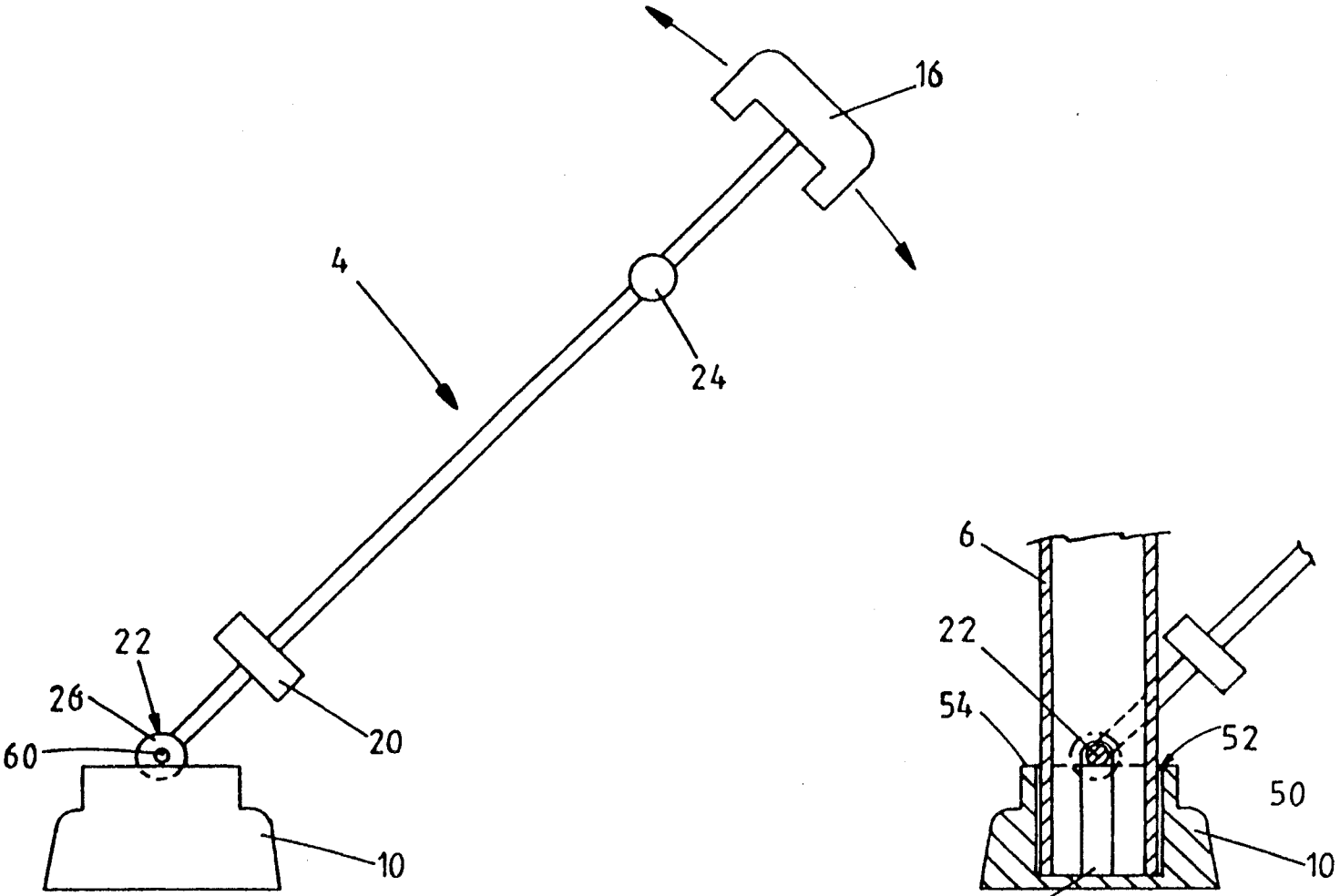
FIG. 3 is a side view of a rail of the structure.
Figure 4:
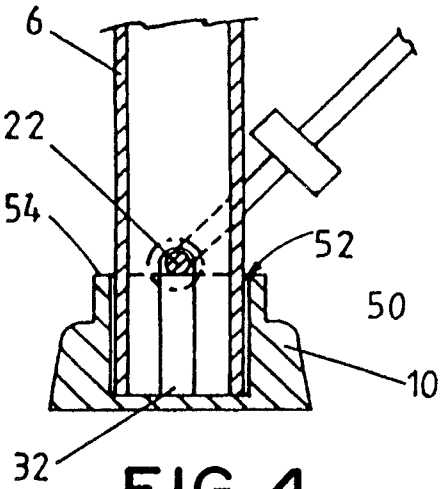
FIG. 4 is a side cross-sectional view of the base of a post of the structure with the rail attached thereto.

The ends of the lower bars 22 are fully secured when the lower ends 50 of the posts are placed in the respective bases 10. A base 10 is configured so as to include a recess 52, as shown in FIGS. 2 and 4, adapted to receive the lower end 50 of a post 6. The depth of the recess 52 is chosen so that the ends of the bars 22 are secured in a position at the ends of the slots 32 by the top 54 of the base 10, as shown in FIG. 4. The engagement of the ends of a lower bar 22 in the posts 6 after insertion in respective bases 10 is such that the rail 4 can be pivoted about the axis 60 of the lower bar 22, as shown in FIG. 3. The lower ends 50 may, of course, be inserted directly into the earth at a depth which is sufficient to secure the bars 22 in the slots 32.

Figure 9:
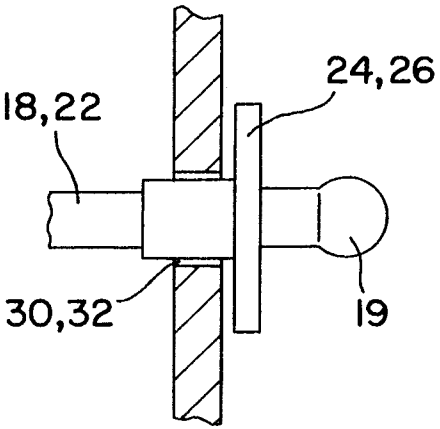
FIG. 9 is a cross-sectional view of the ferrule attached to a bar of the structure.
Figure 8:
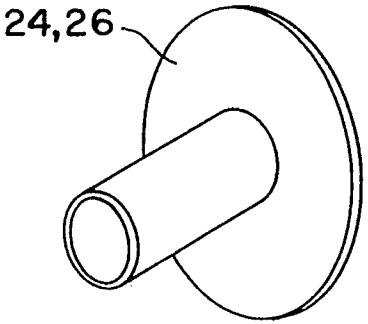
FIG. 8 is a perspective view of a nylon ferrule of the structure.

The knobs 24, 26 may be integral with the respective bars 18, 22 or preferably they comprise nylon ferrules 24, 26, as shown in FIG. 8, which may be inserted over the ends of the bars 18, 22, as shown in FIG. 9. The ferrules 24, 26 are then attached to bars 18, 22 by either welding the ferrules 24, 26 thereto, or flattening the ends 19 of the bars 18, 22, as specifically shown in FIG.

9, so as to prevent the bars 18, 22 being withdrawn through the ferrules 24, 26. The attachment prevents the rails 4 being removed from the posts 6 when a reasonable force is exerted on the rails 4, such as from a person inadvertently running into the structure 2.

To erect the barrier structure 2 the ends of the lower bar 22 are first inserted in the respective slots 32 of two posts 6, as shown in FIG. 2, and the posts 6 then inserted into the respective bases 10. The lower ends 50 of the posts 6 may be fixed to the bases 10 by means of an appropriate bolt 70 or screw and the bases 10 may be secured to the chosen floor structure 12 by means of anchor bolts 72. Once the lower bar 22 has been attached and the lower ends 50 secured the rail 4 may be pivoted, as shown in FIG. 2, about the axis 60 of the bar 22 so as to cause the ends of the upper bar 18 and their respective knobs 24, to be received by the upper slots 30 of the posts 6. Once received the caps 8 are then placed over the upper ends 34 of the posts 6 and erection of the structure 2 is complete.

If two rails 4 are to be attached to one post 6 then the rails 4 should be erected simultaneously.

The length of the first upper and lower bars 16 and 20 are chosen so their respective ends lie adjacent the caps 8 and posts 6 when the structure 2 is erected, as shown in FIG. 1.

From the above, it will be apparent the barrier structure 2 is relatively easy to assemble and requires a minimum of connecting bolts and screws. The structure 2 is also aesthetically pleasing as most of the connecting parts are not visible once the structure 2 is assembled, as shown in FIG. 1.

Figure 10:
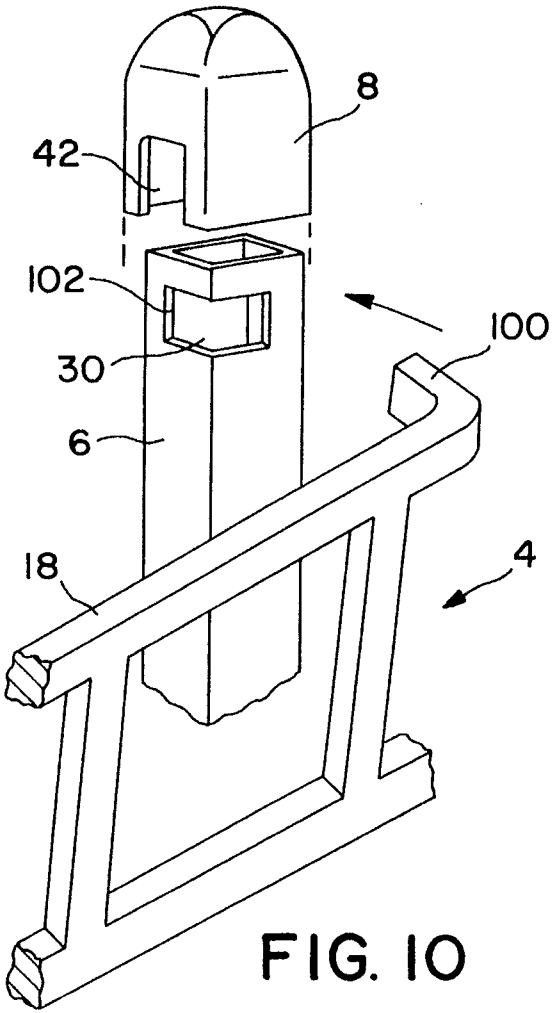
FIG. 10 is a partial perspective view of a second preferred embodiment of a barrier structure.

One alternative engagement configuration and method of engaging the rail 4 with a post 6 is illustrated in FIG. 10 where the end of the upper bar 18 is configured so as to form a hook portion 100 and the upper slot 30 has an L-shape when viewed from above. The slot 30 has one portion on the side of the post 6 and another portion on the front of the post for receiving the bar 18. The hook portion 100 of the bar 18 is formed so it can be received within the slot 30 so the upper bar 18 abuts an end 102 of the slot 30 on the side of the post 6. The hook portion 100 then prevents movement of the bar 18 in the direction of the axis of the bar 18. Inserting the cap 8 onto the post 6 causes the vertical slot 42 of the cap 8 to engage the sides of the bar 18 and prevent lateral movement of the bar 18 from the slot 30.

Figure 11:
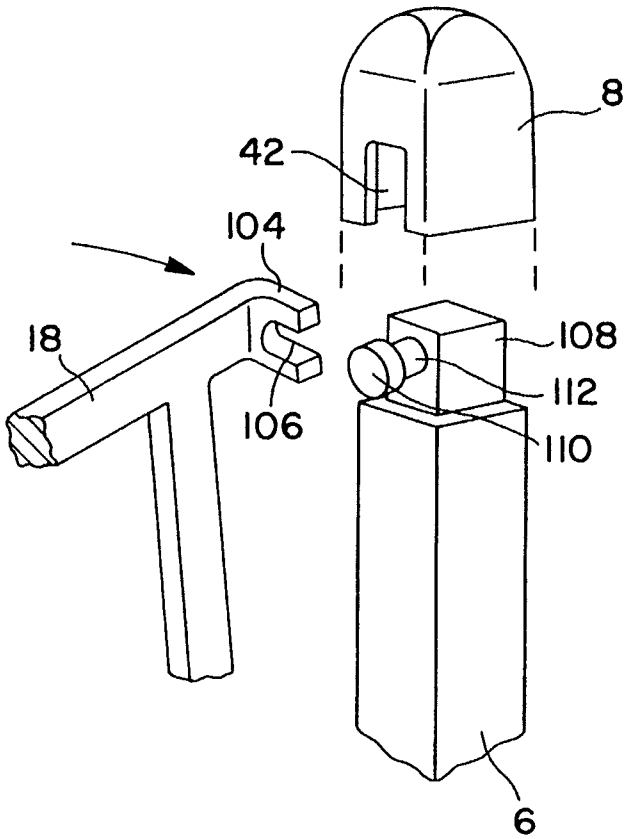
FIG. 11 is a partial perspective view of a third preferred embodiment of a barrier structure.

A second alternative configuration for causing the upper bar 18 to engage a post 6 is illustrated in FIG. 11. The end of the bar 18 again includes a hook portion 104, the hook portion 104 in this instance further includes a horizontal U-shaped channel 106 disposed in the centre thereof. The top of the post 6 is provided with a reduced head portion 108 having a knob 110 which protrudes from the side of the head portion 108. The head portion and knob 110 are configured so the U-shaped channel 106 of the hook portion 104 engages the stem 112 of the knob 110 when the upper bar 118 is pivoted towards the head portion 108. On engaging the stem 112, longitudinal movement in the direction of the axis of the upper bar 18 is prevented by the head portion 108 and the head of the knob 110 engaging with the hook portion 104. After slotting the channel 106 onto the stem 112, the cap 8 can be inserted onto the post 6 so the vertical slot 42 engages the sides of the bar 18 and prevents lateral movement of the bar 18, as described previously.

Figure 12:
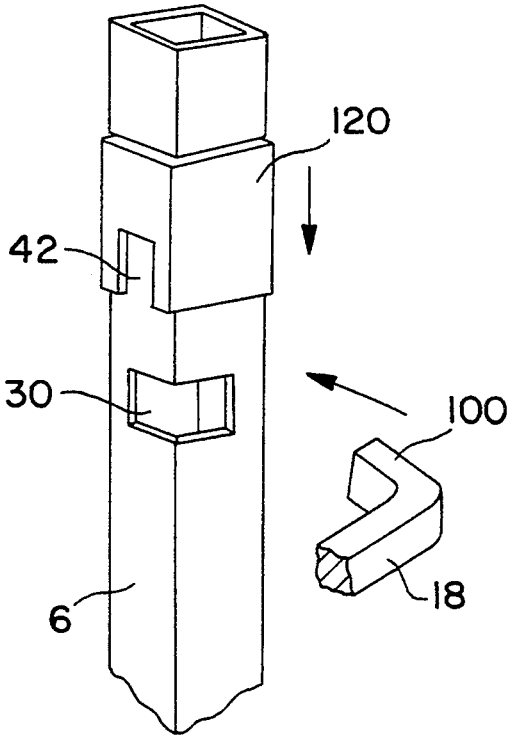
FIG. 12 is a partial perspective view of a fourth preferred embodiment of a barrier structure.

A third alternative configuration and method of attaching an upper bar 18 to a post 6 is illustrated in FIG. 12. For this arrangement, the bar 18 includes a hook portion 100 and the upper slot 30 in the post 6 is L-shaped, as is the case for the configuration illustrated in FIG. 10 and described previously. In this instance, however, the bar 18 is located at lower position relative to the post 6 and, accordingly, the slot 30 is also located at a lower position to receive the hook portion 100. In view of the lowered disposition of the slot 30 and hook portion 100, a sleeve 120 is provided instead of the cap 8. The sleeve 120 is essentially the same as the cap 8 in that it includes the vertical slot 42, however, the top end has been removed so as to enable the sleeve 120 to slide along the post 6 until the vertical slot 42 engages the bar 18, as described previously.

The lower bar 22 could also be formed with the hook portions 100 and 104 in a similar manner to the upper bar 18, as described above, and the base 10 adjusted accordingly, if necessary.

The claims defining the invention are as follows:

1. A barrier structure comprising:

barrier means including upper and lower engaging parts;

elongate support members having engaging portions adapted to receive said engaging parts;

securing means adapted to fit on said support members so as to secure said upper engaging parts to their respective engaging portions; and a base; and wherein:

said support members are inserted into said base so as to secure said lower engaging parts to their respective engaging portions;

said engaging portions comprise slots, said slots including upper slots adjacent a first end of said members to receive said upper engaging parts, and lower slots adjacent a second end of said members to receive said lower engaging parts;

said engaging parts comprise protrusions disposed on the sides of said barrier means, said protrusions each including a stem portion which can be slidably moved in a respective one of said slots, and a flange portion which inhibits movement of the protrusion from the respective slot when inserted therein; and said upper slots each include a vertical slot portion disposed on the front of a respective one of said support members for receiving the flange portion of a respective one of said upper protrusions and a horizontal slot portion disposed on the side of said support member for receiving the stem portion of the respective upper protrusion.

2. A barrier structure as claimed in claim 1, wherein said support members (6) are substantially upstanding and disposed alongside said barrier means (4) when attached thereto.

3. A barrier structure as claimed in claim 1, wherein said securing means include vertical slots disposed on the sides thereof for receiving the stem portions of respective upper protrusions, wherein said cap means, when inserted on the first end of one of said support members having one of said upper protrusions slotted therein, covers the vertical slot portion and inhibits movement of the upper protrusion along the horizontal slot portion.

4. A barrier structure as claimed in claim 1, wherein said lower slots each include a vertical slot disposed on a side of said support members for receiving the stem portion of a respective one of said lower protrusions.

5. A barrier structure as claimed in claim 4, wherein the second end of one of said support members having one of said lower protrusions slotted therein is inserted into said base at such a depth so the upper surface of said base inhibits movement of said lower protrusion relative to its respective lower slot.

6. A barrier structure as claimed in claim 5, wherein said structure includes said base, which can be mounted on a floor stricture and has a recess of said depth.

7. A method of erecting a barrier structure which comprises a barrier structure comprising:

barrier means including upper and lower engaging parts;

elongate support members having engaging portions adapted to receive said engaging parts;

securing means adapted to fit on said support members so as to secure said upper engaging parts to their respective engaging portions; and a base; and wherein:

said support members are insertable into said base so as to secure said lower engaging parts to their respective engaging portions;

said engaging portions comprise slots, said slots including upper slots adjacent a first end of said members to receive said upper engaging parts, and lower slots adjacent a second end of said members to receive said lower engaging parts;

said engaging parts comprise protrusions disposed on the sides of said barrier means, said protrusions each including a stem portion which can be slidably moved in a respective one of said slots, and a flange portion which inhibits movement of the protrusion from the respective slot when inserted therein; and said upper slots each include a vertical slot portion disposed on the front of a respective one of said support members for receiving the flange portion of a respective one of said upper protrusions and a horizontal slot portion disposed on the side of said support member for receiving the stem portion of the respective upper protrusion; said method comprising the steps of:

causing said lower parts to be received by their respective engaging portions;

causing said upper parts to be received by their respective engaging portions; and fitting said securing means on said support members; and wherein said upper parts are caused to engage their respective engaging portions by pivoting said barrier means after the lower parts have been caused to engage their respective engaging portions.

8. A method of erecting a barrier structure which comprises a barrier structure comprising:

barrier means including upper and lower engaging parts;

elongate support members having engaging portions adapted to receive said engaging parts;

securing means adapted to fit on said support members so as to secure said upper engaging parts to their respective engaging portions; and a base; and wherein:

said support members are insertable into said base so as to secure said lower engaging parts to their respective engaging portions;

said engaging portions comprise slots, said slots including upper slots adjacent a first end of said members to receive said upper engaging parts, and lower slots adjacent a second end of said members to receive said lower engaging parts;

said engaging parts comprise protrusions disposed on the sides of said barrier means, said protrusions each including a stem portion which can be slidably moved in a respective one of said slots, and a flange portion which inhibits movement of the protrusion from the respective slot when inserted therein; and said upper slots each include a vertical slot portion disposed on the front of a respective one of said support members for receiving the flange portion of a respective one of said upper protrusions and a horizontal slot portion disposed on the side of said support member for receiving the stem portion of the respective upper protrusion; said method comprising the steps of:

causing said lower parts to be received by their respective engaging portions;

causing said support members to be inserted into said base;

causing said upper parts to be received by their respective engaging portions; and fitting said securing means on said support members; and wherein said upper parts are caused to engage their respective engaging portions by pivoting said barrier means after the support members have been inserted into said base.

9. A method as claimed in claim 8, wherein said securing means include vertical slots disposed on the sides thereof for engaging said barrier means to inhibit lateral movement thereof after said securing means is fitted onto said support members.

10. A method as claimed in claim 9, wherein said securing means are adapted to be slidably inserted onto said posts.

11. A method as claimed in claim 10, wherein said securing means comprise caps or sleeves.

12. A barrier structure comprising:

barrier means including upper and lower engaging parts;

elongate support members having engaging portions adapted to receive said engaging parts;

securing means adapted to fit on said support members so as to secure said upper engaging parts to their respective engaging portions; and a base; and wherein:

said support members are inserted into said base so as to secure said lower engaging parts to their respective engaging portions;

said engaging portions comprise slots, said slots including upper slots adjacent a first end of said members to receive said upper engaging parts, and lower slots adjacent a second end of said members to receive said lower engaging parts;

said engaging parts comprise protrusions disposed on the sides of said barrier means, said protrusions each including a stem portion which can be slidably moved in a respective one of said slots, and a flange portion which inhibits movement of the protrusion from the respective slot when inserted therein; and said upper slots each include a first slot portion disposed on the front of a respective one of said support members through which the flange portion of a respective one of said upper protrusions passes and a second slot portion disposed on the side of said support member for receiving the stem portion of the respective upper protrusion after the flange portion has passed through the first slot portion.

* * * * *